US010714283B2

(12) United States Patent
Stuklek et al.

(10) Patent No.: US 10,714,283 B2
(45) Date of Patent: Jul. 14, 2020

(54) SWITCH FOR AN ELECTRICAL DEVICE

(71) Applicant: ELRAD International d.o.o., Gornja Radgona (SI)

(72) Inventors: Franc Stuklek, Celje (SI); Rudolf Faude, Balingen (DE)

(73) Assignee: ELRAD INTERNATIONAL D.O.O. (SI)

( * ) Notice: Subject to any disclaimer, the term of this patent is extended or adjusted under 35 U.S.C. 154(b) by 43 days.

(21) Appl. No.: 15/752,906

(22) PCT Filed: Aug. 2, 2016

(86) PCT No.: PCT/EP2016/068371
§ 371 (c)(1),
(2) Date: Feb. 15, 2018

(87) PCT Pub. No.: WO2017/032564
PCT Pub. Date: Mar. 2, 2017

(65) Prior Publication Data

US 2018/0240625 A1 Aug. 23, 2018

(30) Foreign Application Priority Data

Aug. 21, 2015 (DE) ..... 10 2015 113 949

(51) Int. Cl.
*H01H 19/06* (2006.01)
*H01H 9/04* (2006.01)
(Continued)

(52) U.S. Cl.
CPC ..... *H01H 19/06* (2013.01); *H01C 10/50* (2013.01); *H01H 9/04* (2013.01); *H01H 9/061* (2013.01);
(Continued)

(58) Field of Classification Search
CPC ..... H01H 19/06; H01H 9/04; H01H 9/061; H01H 19/46; H01C 10/50
(Continued)

(56) References Cited

U.S. PATENT DOCUMENTS 1,772,982 A 8/1930 Brachtl
4,665,290 A 5/1987 Piber
(Continued)

FOREIGN PATENT DOCUMENTS

CN 103854900 A 6/2014
DE 3634158 A1 4/1988
DE 10019471 A1 3/2001

OTHER PUBLICATIONS

International Search Report for patent application No. PCT/EP2016/068371, dated Oct. 25, 2016, 11 pages.
(Continued)

*Primary Examiner* — Edwin A. Leon
*Assistant Examiner* — Iman Malakooti
(74) *Attorney, Agent, or Firm* — Lucian Wayne Beavers; Patterson Intellectual Property Law, PC

(57) ABSTRACT

The invention relates to a switch for an electrical device, in particular for an electrical tool, comprising a slide control for setting a rotational speed of the electrical device, a switch housing, and at least one circuit board arranged in the switch housing for holding electrical components of the slide control. According to the invention, a movably supported operating element of the slide control is inserted into a contact chamber of the switch housing in a sealed manner through a first feed-through and is led out of the contact chamber in a sealed manner through a second feed-through in all adjustment positions of the operating element. Thus, a switch that ensures reliable function even under ambient conditions of high contamination is provided.

12 Claims, 4 Drawing Sheets

Figure 1:
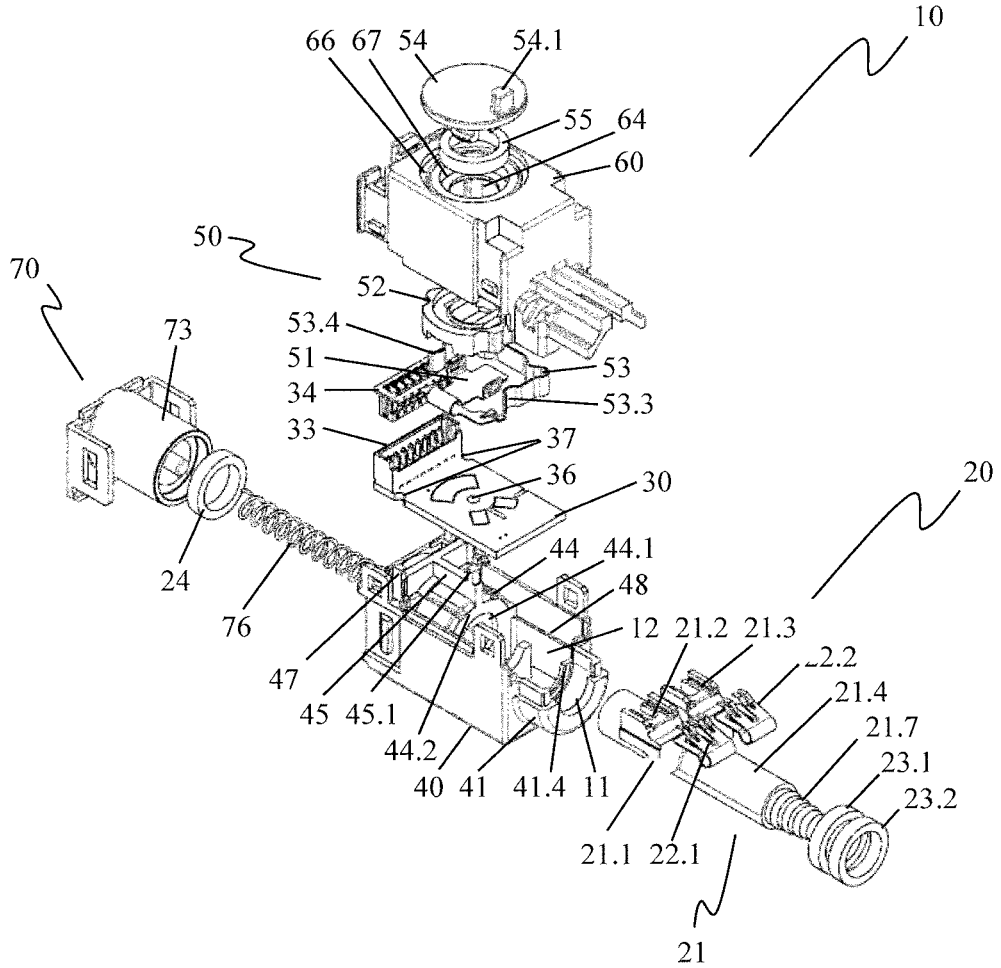

(51) Int. Cl.

| | |
|---|---|
| ***H01H 9/06*** | (2006.01) |
| ***H01C 10/50*** | (2006.01) |
| ***H01H 19/46*** | (2006.01) |
| *H01H 13/52* | (2006.01) |
| *H01H 19/38* | (2006.01) |

(52) U.S. Cl.
CPC ..... *H01H 19/46* (2013.01); *H01H 9/063* (2013.01); *H01H 13/52* (2013.01); *H01H 19/38* (2013.01); *H01H 2239/078* (2013.01)

(58) Field of Classification Search
USPC ..... 200/6 R, 522; 277/500; 173/170
See application file for complete search history.

(56) References Cited

U.S. PATENT DOCUMENTS

| | | | | |
|---|---|---|---|---|
| 5,555,775 | A | 9/1996 | D'Aluisio et al. | |
| 9,224,551 | B2 * | 12/2015 | Rueblinger ..... | G06K 7/10881 |
| 2011/0168420 | A1 | 7/2011 | Kobayashi et al. | |
| 2014/0166449 | A1 | 6/2014 | Ho et al. | |
| 2014/0225331 | A1 * | 8/2014 | Hozumi ..... | H01H 9/063 277/500 |
| 2015/0279592 | A1 * | 10/2015 | Ekstrom ..... | H01H 21/12 200/522 |

OTHER PUBLICATIONS

Office action of Apr. 25, 2018 in corresponding German application 10 2015 113 949.9.

* cited by examiner

SWITCH FOR AN ELECTRICAL DEVICE

The invention relates to a switch for an electrical device, in particular for an electrical tool, with a slide control for setting the speed of the electrical device, with a switch housing and with at least one printed circuit board, arranged in the switch housing, for receiving electrical components of the slide control.

Switches of this type are used, for example, as multi-way switches in electrical devices, in particular in drills, electric screwdrivers and other electric hand tools, or also in household devices. The slide control can here be adjusted via an operating element which can be depressed or shifted usually linearly counter to a restoring force. Slide controls are known which are arranged directly in a power circuit of the electrical device or in a control circuit operated with low voltage and low current. Slide controls operated with low voltage and low current deliver an output signal which is usually emitted proportionally to the position of the slide control and is supplied to a power electronics unit. The latter amplifies the output signal and supplies it to a drive unit of the electrical device. The speed of the electrical tool can, for example, thus be adjusted via the slide control.

In addition to the slide control, multi-way switches contain other switching elements, for example for changing the direction of rotation of the drive unit or for switching the electrical device on and off. These switching elements thus often act on the power circuit of the electrical device. It can alternatively be provided that the switching elements are arranged in the control circuit and their switching signals are correspondingly passed on to the power electronics unit.

It is known to design slide controls as potentiometers and therefore as variable ohmic resistors, for example with sliding contacts. The sliding contacts are connected to the operating element, for example by means of a mechanical transmission.

It is moreover known to design slide controls as capacitive travel sensors, as described in DE 10 2011 002 009 A1, which discloses a capacitive travel sensor with a housing which can be attached to a printed circuit board. The housing has a receptacle in which a slide can be housed movably. The slide is arranged permanently in a reference region between a first measurement electrode and an opposite ground electrode. As a result of the sliding movement, the slide is introduced more or less far into a measurement region between a second measurement electrode and a second ground electrode, wherein the ground electrodes of the reference and the measurement region can be designed as one-piece electrodes. The change in the capacity between the electrodes arranged in the measurement region and the capacity between the electrodes arranged in the reference region when the slide moves is evaluated. The measurement electrodes can here be arranged on the printed circuit board, while the ground electrode is integrated into the cover of the housing.

Both the capacitive travel sensor described and the ohmic travel sensor operate in a control circuit at low currents and voltages. In both cases, even low amounts of contamination of the contacts and the electrodes result in damage to the controlled electrical device and hence in its malfunction. The other required switching elements are advantageously also integrated into the control circuit. Switches are here formed according to known arrangements via two open contact surfaces, arranged on the printed circuit board, which can be bridged by a conductive bridge. This cost-effective design has, however, the disadvantage that dust and dirt that gets into the region of the contact surfaces can modify the transition resistance between the contact surfaces and the bridge so much that the functioning of the switch is disrupted. Disruption occurs in particular at the low voltages and currents used in the control circuit even when there is a relatively little amount of contamination.

During the activation of the slide control, the operating element is pressed into a switch housing counter to a restoring force and, when the pressure is released, moved back out of the switch housing as far as an abutment. Space in the switch housing is displaced and freed up again by the operating element which is moved in and out of the switch housing. A pump effect, in which the air pressure in the switch housing is changed, occurs as a result. Air is consequently forced out of the housing and then sucked back in again. Dirt and dust are also drawn into the switch housing in the sucked-in air, through tiny openings and cracks. The amount of dust and dirt introduced into the switch housing is many times greater than the amount which penetrates into the switch housing when the operating element is not activated and hence when no air is sucked in. The dirt and dust are deposited in particular on the open contacts of the control circuit and cause disruption.

The object of the invention is to provide a switch which operates at low voltages and at low currents, in particular a multi-way switch which provides a control signal proportional to the travel and which, with a simple design, is less prone to failure caused by contamination.

The object of the invention is achieved by a movably mounted operating element of the slide control being inserted in all adjustment positions of the operating element, in sealed fashion, through by a first bushing, into a contact space of the switch housing, and being extracted from the contact space, in sealed fashion, through a second bushing. A portion of the operating element is thus pushed into the contact space, and at the same time a portion is pushed out of the contact space, by activation of the operating element. Thus, no space is displaced or freed up in the contact space. A pump effect in which the air pressure inside the contact space, relative to the environment, rises and falls and consequently air is displaced from the contact space and then sucked back in again can thus be prevented. This has the consequence also that no dust and dirt is drawn into the contact space of the switch housing with the sucked-in air. The operating element is inserted and into and removed from the contact space in a sealed fashion in such a way that no dust or dirt is in so doing spread over its surface inside the contact space. The switch housing is advantageously designed so that it is dust-tight to such an extent that no or only a little dust or dirt can get into the switch housing or into the contact space when there is no assisting difference in air pressure. The ingress of dust and dirt into the contact space can thus be significantly reduced by preventing the pump effect. This is advantageous in particular in the case of switches which operate with low voltages and contacts which are open in the contact space because here even low amounts of contamination can result in disruption. For example in the case of electrical tools, such disruption can result in it no longer being possible for, for example, the speed of the electrical tool to be adjusted in a controlled fashion, which represents a high safety risk. Safety when electrical devices are being operated can thus also be improved by the switch according to the invention.

The movement of air between the contact space and the dust- and dirt-laden environment can be reliably prevented by the displaced volume of that portion of the operating element which is inserted into the contact space during adjustment of the slide control, and the displaced volume of that portion of the operating element which is extracted from the contact space during adjustment, being the same or deviating from each other by no more than 10%. The operating element can, for example, be formed from a rod with the same external diameter in the region of the contact space. As a result, when the operating element is activated no pump effect, or only a small one, is caused so that no air is displaced from the contact space or drawn into the contact space.

An output signal of the switch which is proportional to the position of the operating element can be obtained by the slide control being designed as a linear potentiometer, by at least one sliding contact of the linear potentiometer being directly or indirectly fastened on the operating element, and by the sliding contact interacting with resistance tracks applied to the printed circuit board, or by the slide control being designed as a capacitive travel sensor and by a slide of the capacitive travel sensor, arranged depending on the adjustment position of the operating element in places between at least two electrodes, being fastened directly or indirectly on the operating element. The design of the switch according to the invention prevents dirt and dust penetrating the contact space. The sliding contacts and resistance tracks can thus be arranged in the contact space so that they are open and have no additional encapsulation. As a result, the manufacturing costs of the switch compared with switches with encapsulated switching elements can be significantly reduced. The capacitive travel sensor can also be open in design without any penetrating dust or dirt affecting its functioning. The operating element is preferably designed as a rod with an identical diameter in the regions which can be pushed into the contact space and extracted again therefrom. The sliding contacts and the slide are fastened on the operating element in a region of the operating element which lies inside the contact space in all adjustment positions of the operating element. The adjustment travel of the operating element can advantageously be limited by abutments.

The operating element can advantageously be adjusted counter to a restoring force. For this purpose, it can be provided that the operating element has a spring receptacle in a region arranged outside the contact space, that a counter-bearing for a spring can be fastened on the switch housing, and that the spring is tensioned between the counter-bearing and the spring receptacle and pretensions the operating element. Such a design enables simple mounting of the switch because the spring can be connected to the operating element from outside and does not need to be mounted inside the switch housing. The spring can here be attached at a late point in time of the mounting of the switch. The components of the switch are thus not mechanically pretensioned by the spring during the mounting, as a result of which the mounting can be simplified and the risk of damage to components of the switch reduced.

A possible embodiment of the invention is characterized in that a rotary switch is associated with the switch, and in that a connection between an activating part and at least one contact element of the rotary switch is introduced, in a sealed and rotatable fashion, into the contact space. The rotary switch advantageously results in no change in volume inside the contact space and hence in the absence of any pump effect. It can be designed as, for example, a right/left toggle switch by means of which the direction of rotation of a motor of an electric tool can be switched, or the electric tool switched off in an intermediate position of the rotary switch.

A cost-effective design of the rotary switch can be enabled by the contact element, depending on the position of the activating part, being in electrically conductive connection with at least one contact surface arranged on the printed circuit board or with no contact surface at all. Here too, the open contact surfaces are possible because no dust or dirt, or only a little, penetrates into the contact space. The contact element advantageously bridges two contact surfaces. Different switching situations can be produced by the combination of the contact surfaces connected depending on the position of the switch. If at least one contact of the contact element does not touch any connected contact surface, then the electrical device can consequently be switched off.

In order to obtain distinct switch positions of the rotary switch and orient at least one contact of the contact element in the different switch positions exactly relative to a respective contact surface, it can be provided that a positioning element can be rotated indirectly or directly, connected with the activating part and together with the latter, that a positioning element has a latching curve, and in that a latching element fastened immovably indirectly or directly on the switch housing is actively connected to the latching curve.

If, according to an embodiment, it is provided that an electrical connection of the printed circuit board leads, in a sealed fashion, out of the switch housing and/or the contact space, the signals of the switch can be supplied to a downstream electronics unit. The sealing of the electrical connection can here be designed in such a simple fashion that any dust lying around loosely is prevented from being able to penetrate into the switch housing.

Simple mounting of the switch is enabled by the switch housing being formed at least from a bottom housing part and a top housing part connected to the bottom housing part via latching connections. Before assembly, the switch components can be mounted in the housing parts and the latter can then be joined together. By virtue of the latching connection, a connection between the housing parts can be produced which is as dust-tight as possible so that no dust or dirt is able to penetrate into the contact space without the described pump effect.

According to a preferred alternative embodiment of the invention, it can be provided that the switch is operated with low voltage, preferably with a voltage that is less than or equal to 12 V, and that output signals of the switch are supplied to a power electronics unit. The switch can be constructed cost-effectively by virtue of the use of low voltages. This results, for example, from the low required distances between live components and from the fact that the insulation measures which are required for high voltages are no longer required. The electrical power required to operate the electrical device to be switched is provided by the downstream power electronics unit.

Figure 2:
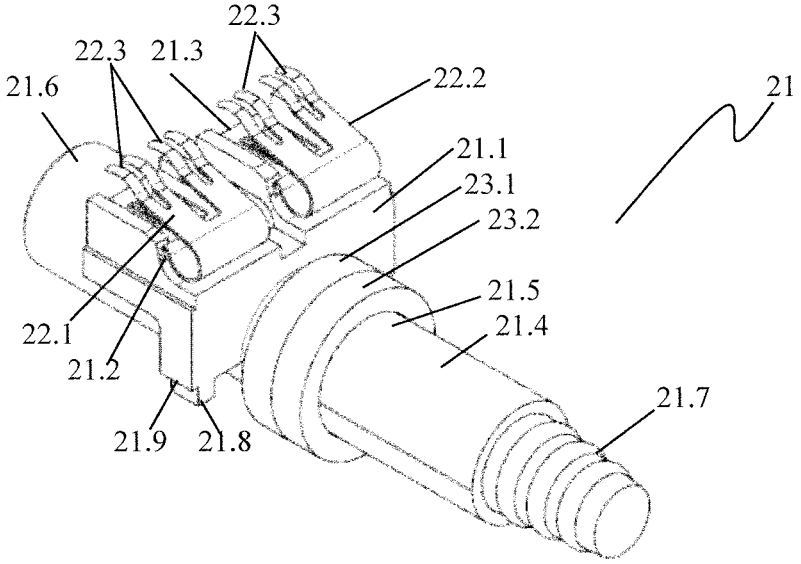
Figure 3:
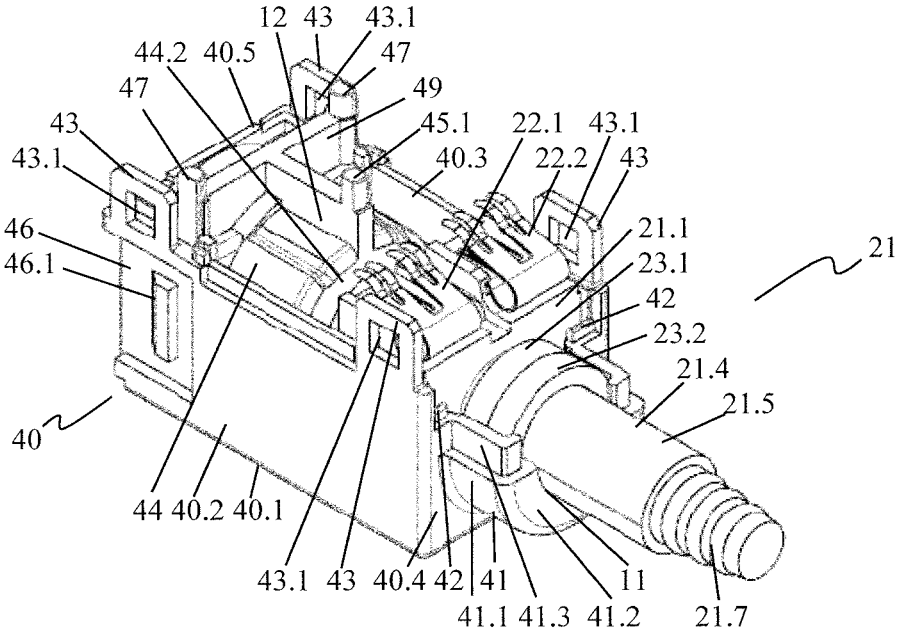
Figure 4:
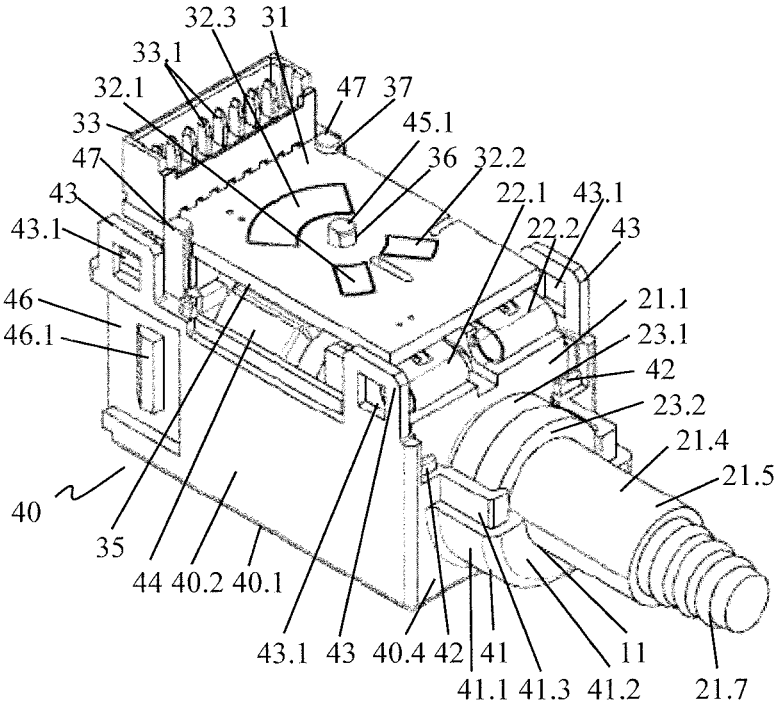
Figure 5:
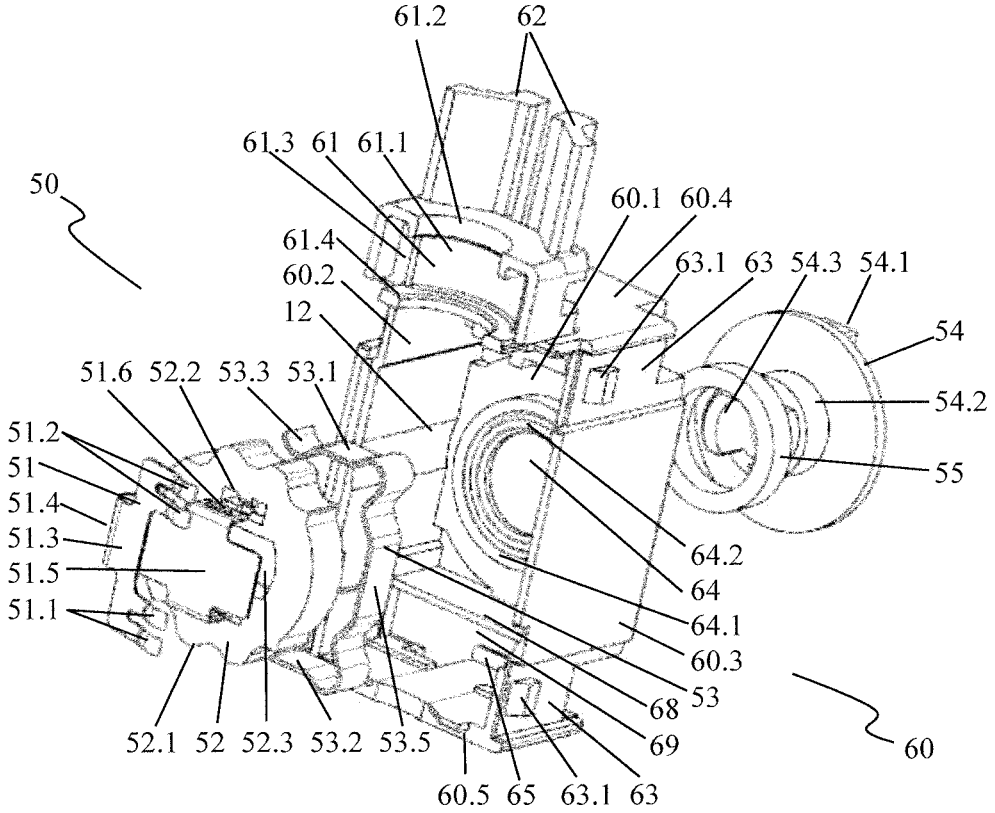
Figure 6:
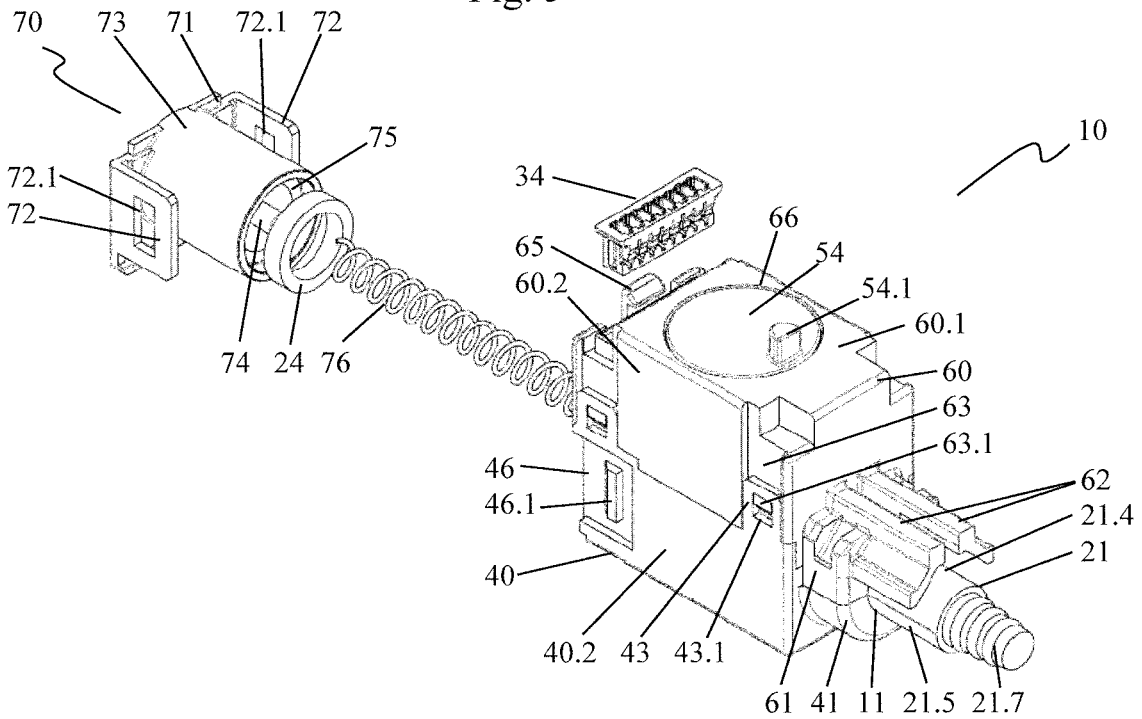
Figure 7:
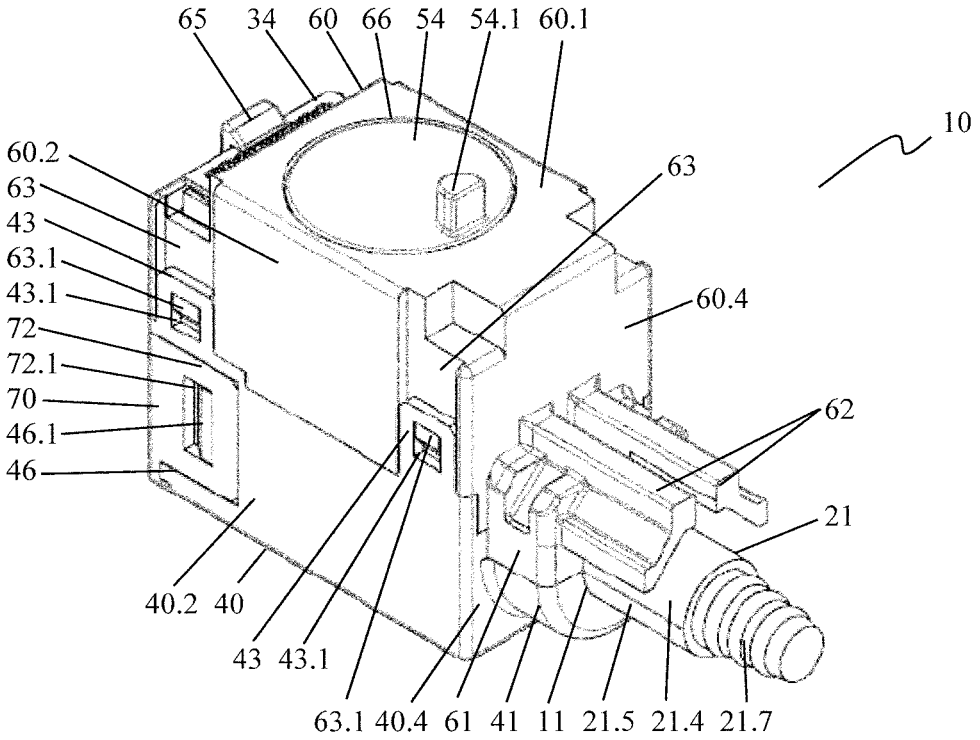

The invention is explained in detail below with the aid of the exemplary embodiments shown in the drawings, in which:

FIG. 1 shows, in a perspective side view, an exploded drawing of a switch with a slide control, FIG. 2 shows, in a perspective side view, in a first mounting stage, a slide element of the slide control shown in FIG. 1, with sliding contacts, FIG. 3 shows, in a perspective side view, in a second mounting stage, a bottom housing part with an incorporated operating element shown in FIG. 2, FIG. 4 shows, in a perspective side view, in a third mounting stage, the bottom housing part shown in FIG. 3, with a mounted printed circuit board, FIG. 5 shows, in a perspective side view, an exploded drawing of a top housing part with a rotary switch, FIG. 6 shows, in a perspective side view and a partial exploded representation, in a fourth mounting stage, the bottom housing part shown in FIG. 3 in conjunction with the top housing part shown in FIG. 5, and FIG. 7 shows, in a perspective side view, in a fifth mounting stage, the completely mounted switch shown in FIG. 1.

FIG. 1 shows, in a perspective side view, an exploded drawing of a switch 10 with a slide control 20. The switch 10 is here constructed as a multi-way switch from the components a slide valve 20, a printed circuit board 30, a bottom housing part 40, a rotary switch 50, a top housing part 60, and a counter-bearing 70. In the exemplary embodiment, the switch 10 serves to control an electric tool (not shown) with an adjustable speed and right/left-hand rotation.

The slide control 20 is designed as an ohmic slide control 20. It is formed from a slide element 21 with sliding contacts 22.1, 22.2, associated therewith, and from resistance tracks which are arranged (not shown) on that side of the printed circuit board 30 which faces the bottom housing part 40. For this purpose, a guide portion 21.1 is integrally formed on an operating element 21.4. The guide portion 21.1 bears sliding contact receptacles 21.2, 21.3. The operating element 21.4 is designed in the form of a rod. In the exemplary embodiment shown, it has a round cross-section. The operating element 21.4 is closed off at an end accessible to the user by a tapering shaft end 21.7. Furthermore, two front sealing rings 23.1, 23.2 are associated with the operating element 21.4. The operating element 21.4 and the guide portion 21.1 are preferably produced in a single piece from plastic.

The bottom housing part 40 of the switch housing is arranged in an extension of the slide element 21. The bottom housing part 40 here has, longitudinally aligned with the operating element 21.4, a first bushing 11 and on the rear a second bushing 44.1. The first bushing 11 is half-formed by a lower sealing ring receptacle 41 which is closed toward a contact space 12 by a lower inner half-shell closing piece 41.4. The second bushing 44.1 is integrally formed in a sleeve closing piece 44.2 of an external sleeve 44 introduced into the bottom housing part 40 and the contact space 12. Toward the printed circuit board 30, in a longitudinal extension of the external sleeve 44, a web 45 with a centering projection 45.1 is integrally formed on said external sleeve. Furthermore, two printed circuit board holders 47, preferably semi-circular in design, are arranged opposite each other on the bottom housing part 40, facing the printed circuit board 30. Guide rails 48 in the form of steps are integrally formed opposite each other laterally in the housing wall of the bottom housing part 40, wherein only one of the guide rails 48 can be seen in the selected view. The bottom housing part 40 receives a lower region of the contact space 12.

The printed circuit board 30 is arranged above the bottom housing part 40. It has a centering opening 36, in an extension of the centering projection 45.1. Notches 37 are made on the opposite edges of the printed circuit board 30, opposite the printed circuit board holders 47. A plug contact 33 is fastened to the printed circuit board 30 and electrically connected to the latter. A plug 34 corresponding to the plug contact 33 is shown above the plug contact 33.

The top housing part 60 has a switch bushing 64. A sealing ring 67 is incorporated, situated at the circumference of the switch bushing 64. A slide receptacle 66 is provided at the circumference of said sealing ring. An activating part 64 of the rotary switch 50 is arranged above the switch bushing 64. The activating part 54 has a disk-shaped design. On the outside, it has an integrally formed knob 54.1. A sealing ring 55 is associated with the sealing ring receptacle 67.

Furthermore, a positioning element 52, a latching element 53 with two opposite latching regions 53.3, 53.4 and a contact element 51 are associated with the rotary switch 50, as described in detail with respect to FIG. 5.

The counter-bearing 70 is associated with the bottom housing part 40, opposite the slide element 21. The counter-bearing 70 has a guide sleeve 73 facing the bottom housing part 40. The external diameter of the guide sleeve 73 is selected such that it can be pushed into the external sleeve 44 of the bottom housing part 40. A rear sealing ring 24 is associated with the guide sleeve 73. A spring 76 is arranged between the bottom housing part 40 and the counter-bearing 70.

FIG. 2 shows, in a perspective side view, in a first mounting stage, the slide element 21 of the slide control 20 shown in FIG. 1 with the sliding contacts 22.1, 22.2.

The sliding contacts 22.1, 22.2 are pushed into the sliding contact receptacles 21.2, 21.3 of the guide portion 21.1. They are designed as bent metal springs which, facing away from the guide portion 21.2, in each case have two contact tongues 22.3, in pairs, which are connected electrically to each other. The sealing rings 23.1, 23.2 are pushed onto a front sealing region 21.5 of the operating element 21.4. Guide projections 21.8 are integrally formed on the guide portion 21.2, on both sides of the operating element 21.4, opposite the sliding contact receptacles 21.2, 21.3. The guide projections 21.8, only the front one of which can be seen, form, together with the base body of the guide portion 21.1, in each case an angular guide region 21.9. The operating element 21.4 has a rear sealing region 21.6, opposite the shaft end 21.7 and downstream from the guide portion 21.1.

FIG. 3 shows, in a perspective side view, in a second mounting step, the bottom housing part 40 with the incorporated operating element 21.4 shown in FIG. 2.

The bottom housing part 40 is formed from a housing base 40.1, from which a first side wall 40.2 and an opposite second lower side wall 40.3 depart. A lower front wall 40.4 and a lower rear wall 40.5 are connected to the housing base 40.1 and the lower side walls 40.2, 40.3. Two tab-like latching elements 43 are in each case integrally formed on the lower side walls 40.2, 40.3, facing the top housing part 60 shown in FIG. 1. The tab-like latching elements 43 have latching receptacles 43.1 in the form of openings. Opposite receptacles 46 are let into the lower side walls 40.2, 40.3, facing the counter-bearing 70 which is likewise shown in FIG. 1. Catches 46.1 are arranged inside the receptacles 46.

The bottom front wall 40.4 is designed so that it is lower than the bottom side walls 40.2, 40.3. The bottom sealing ring receptacle 41 is arranged on the bottom front wall 40.4. It is formed from a bottom half-shell 41.1, integrally formed on the bottom front wall 40.4, which, facing the outside of the switch housing, is bounded by a bottom outer half-shell closing piece 41.2 and, facing the switch housing, by the bottom inner half-shell closing piece 41.4 shown in FIG. 1. The inner and the outer half-shell closing piece 41.4, 41.2 enclose half of the first bushing 11 of the switch housing. A positive-locking element 41.3 is integrally formed on the bottom half-shell 41.1 and the outer half-shell closing piece 41.2, facing the top housing part 60. The positive-locking element 41.3 merges at an angle into the bottom front wall 40.4.

Two connecting tabs 42 are arranged on the bottom front wall 40.4, likewise facing the top housing part 60.

The slide element 21 is placed inside the bottom housing part 40. To do this, the operating element 21.4 is passed through the first bushing 11 into the contact space 12 and through the second passage 44.1 out of the contact space 12. The front sealing rings 23.1, 23.2 are placed into the bottom sealing ring receptacle 41 and locked axially by the bottom inner and bottom outer half-shell closing piece 41.4, 41.2. An axial sliding bearing is formed between the front sealing rings 23.1, 23.2 and the front sealing region 21.5 of the operating element 21.4. The operating element 21.4 can thus be pushed into the slide housing and extracted from it again, sealed along its longitudinal axis.

A bottom partition wall 49 is arranged between the printed circuit board holders 47, spaced apart from the bottom rear wall 40.5. The bottom partition wall 49 encloses, together with the housing base 40.1, the bottom side walls 40.2, 40.3, and the bottom front wall 40.4, the bottom part region of the contact space 12. The partition wall 49 abuts the top housing part 60 with the web 45. The external sleeve 44 is guided to the bottom rear wall 40.5 through the partition wall 49.

The slide element 21 is guided, so that it can move linearly, with its guide portion 21.1 in the bottom housing part 40. For this purpose, the guide portion 21.1 lies with its guide regions 21.9 shown in FIG. 2 on the guide rails 48 formed in the bottom side walls 40.2, 40.3. The slide element 21 can thus be displaced axially with respect to the operating element 21.4 but cannot be rotated about the longitudinal axis of the operating element 21.4. As a result, the sliding contacts 22.1, 22.2 remain oriented toward the printed circuit board 30 shown in FIG. 1.

FIG. 4 shows, in a perspective side view, in a third mounting stage, the bottom housing part 40 shown in FIG. 3 with a mounted printed circuit board 30.

Two contact surfaces 32.1, 32.2 and a counter-contact surface 32.3 are attached on a switching side 31 of the printed circuit board 30 facing away from the bottom housing part 40. The contact surfaces 32.1, 32.2 and a counter-contact surface 32.3 are here arranged, in the manner of segments of a circle, along a circular path. The first and second contact surface 32.1, 32.2 each cover a relatively small segment of a circle and are oriented toward the bottom front wall 40.4. The counter-contact surface 32.3 covers a larger segment of a circle and is oriented toward the bottom rear wall 40.5. The segment of a circle covered by the counter-contact surface 32.3 is so large that it covers the segment of a circle lying diametrically opposite the first and the second contact surface 32.1, 32.2.

The printed circuit board 30 has a sliding resistor side 35 facing the bottom housing part 40. Four resistance tracks (not shown) of the slide control 20 are attached to said sliding resistor side. The resistance tracks are here arranged in the bottom region of the contact space 12. The sliding contacts 22.1, 22.2 each bear against a resistance track with their contact tongues 22.3 (shown in FIG. 2). They thus produce an electrical contact with the resistance tracks. Two resistance tracks are electrically connected via in each case one sliding contact 22.1, 22.2. The preferably inner resistance tracks are connected to one another at their ends. The resistance tracks connected in series in this way via the sliding contacts produce a total resistance which is proportional to the location at which the sliding contacts 22.1, 22.2 bear against the resistance tracks, and hence proportional to the position of the slide element 21. The outer resistance tracks are connected electrically to contact pins 33.1 of the plug contact 33 so that the resistance can be measured from outside and used as a control signal for a power electronics unit (not shown) of an electrical device.

The centering projection 45.1 arranged on the web 45 of the bottom housing part 40 is guided through the centering opening 36 of the printed circuit board 30. The printed circuit board 30 is guided laterally in the region of its notches 37 through the printed circuit board holder 47. It bears with its sliding resistor side 35 on the web 45 (shown in FIG. 3) and the bottom partition wall 49. As a result, it is positioned exactly opposite the sliding contacts 22.1, 22.2. The sliding resistor side 35 is arranged so tightly against the slide element 21 that the sliding contacts 22.1, 22.2 are pressed with their contact tongues 22.3 with spring tension against the resistance tracks. As a result, contact interruptions, for example caused by strong vibrations, can be prevented.

An exploded drawing of the top housing part 60 with the rotary switch 50 is shown in a perspective side view in FIG. 5. The top housing part 60 has a housing cover 60.1, starting from which two opposite top side walls 60.2, 60.3 and a top front wall 60.4 and top rear wall 60.5 connecting the top side walls 60.2, 60.3 extend toward the bottom housing part 40 shown in FIG. 3. The housing interior formed in this way is divided by a top partition wall 68 which extends between the two top side walls 60.2, 60.3. The top partition wall 69 partitions off a top region of the contact space 12.

A top sealing ring receptacle 61 is integrally formed on the top front wall 60.4, facing away from the contact space 12. The top sealing ring receptacle 61 is formed by a top half-shell 61.1 which, facing the contact space 12, is bounded by a top inner half-shell closing piece 61.4 and, opposite this, by a top outer half-shell closing piece 61.2. The top half-shell 61.1 is closed circumferentially by a positive-locking counter-element 61.3. The top region of the first bushing 11 is formed as an opening in the inner and the outer half-shell closing piece 61.4, 61.2. Two guide rails 62 facing away from the switch housing are integrally formed on the sealing ring receptacle 61.

In each case two recesses 63 are provided on the top side walls 60.2, 60.3. Latching cams 63.1 which are beveled toward the bottom housing part 40 are arranged in the region of the recesses.

A base 64.2 of the sealing ring receptacle 67 shown in FIG. 1 is integrally formed circumferentially with the switch bushing 64 in the housing cover 60.1.

A plug opening 69 is incorporated in the housing cover 60.1 through the top partition wall 68, separate from the contact space 12. A plug latching means 65 is integrally formed at the sides of the plug opening 69 on the upper rear wall 60.5 of the switch housing.

An annular projection 54.2 with a driver 54.3 is integrally formed on that side of the activating part 54 which faces the bottom housing part 60. The annular projection 54.2 and the driver 54.3 are formed such that they can be pushed through the sealing ring 55 and the switch bushing 64.

The positioning element 52 is arranged in an axial extension of the activating part 54. It has a driver receptacle 52.3 in the form of an opening into which the driver 54.3 of the activating part 54 can be pushed. A force fit between the driver 54.3 and the driver receptacle 52.3 results here. Two opposite clamp receptacles 52.2 are made in the positioning element 52 on the sides of the driver receptacle 52.3. A latching curve 52.1 is arranged at the circumference of the positioning element 52. The latching curve 52.1 is formed in the positioning element 52 as a series of peaks and troughs. The positioning element 52 is preferably made from plastic. The latching element 53 is associated with the latching curve 52.1. It has two limbs 53.1, 53.2 connected via a connecting portion 53.5. The connecting portion 53.5 is oriented with its external surface facing the second top side wall 60.3 of the top housing part 60. It can thus be fixed to the latter during the mounting. The limbs 53.1, 53.2 extend tangentially to the positioning element 52. In each case a latching region 53.3, 53.4 is arranged at the ends of the limbs 53.1, 53.2. The latching regions 53.3, 53.4 are formed such that, when the switch 10 is mounted, they engage on opposite sides in the latching curve 52.1. The latching element 53 is manufactured from a springy elastic material, preferably from metal.

The contact element 51 is associated with the positioning element 52, facing away from the activating part 54. The contact element 51 has a holding region 51.5, flat in design, on which two clamps 51.6 are integrally formed, angled with respect to positioning element 52. The clamps 51.6 are arranged such that they can be pushed into the clamp receptacles 52.2 of the positioning element 52 and clamped there. The holding region 51.5 is connected to a bridge 51.3, arranged at a distance from the holding region 51.5, via a bending portion 51.4. Two contacts 51.1, 51.2, in each case in pairs, are integrally formed on said bridge. The contact element 51 is manufactured from metal, preferably from a springy elastic metal.

For mounting, the latching element 53 is introduced into the contact space 12 and fixed there with its connecting portion 53.5 at the second top side wall 60.3. The latter has corresponding brackets (not shown) for this purpose. The sealing ring 55 is pushed onto the annular projection 54.2 of the activating part 54. The driver 54.3 is then inserted through the switch bushing 64 into the switch housing. The sealing ring 55 is thus seated in the sealing ring receptacle 67 shown in FIG. 1, and the activating part 54 in the disk receptacle 66. The contact element 51 is fixed with its clamps 51.6 in the clamp receptacles 52.2 of the positioning element 52. The positioning element 52 is then pushed with its driver receptacle 52.3 onto the driver 54.3 of the activating part 54. The latching element 53 engages with its latching regions 53.3, 53.4 in the latching curve 52.1 of the positioning element 52. A force fit is formed between the driver 54.3 and the driver receptacle 52.3. It holds the rotary switch 50 together axially. The positioning element 52 and the contact element 51 connected thereto is rotated about the axis of rotation of the activating part 54 via the driver 54.3 by rotation of the activating part 54. The interaction of the latching element 53 with the latching curve 52.1 thus permits only predetermined switching positions.

FIG. 6 shows, in a perspective side view, a partial exploded view, in a fourth mounting stage, of the bottom housing part 40 shown in FIG. 3 in conjunction with the top housing part 60 shown in FIG. 5.

The counter-bearing 70 is directed with its guide sleeve 73 toward the bottom housing part 40 and there toward an outer opening of the external sleeve 44 shown in FIG. 3. The guide sleeve 73 is connected at the end to a baseplate 71 extending transversely to the longitudinal extension of the guide sleeve 73. Angled latching limbs 72 are integrally formed on the baseplate 71 on both sides of the guide sleeve 73. The latching limbs 72 have latching recesses 72.1. They are oriented toward the receptacles 46 and the catches 46.1 on the bottom side walls 40.2, 40.3 of the bottom housing part 30. A centering pin 74 is arranged, axially oriented, in the guide sleeve 73. A sealing receptacle 75 is formed on that end of the guide sleeve 73 facing the bottom housing part 40. The sealing receptacle 75 forms a gradual tapering of the internal diameter of the guide sleeve 73. The rear sealing ring 24 can thus be placed inside the sealing receptacle 75 and retained both axially and radially. The spring 76 is arranged in an extension of the central longitudinal axis of the centering pin 74 and in an extension of the central longitudinal axis of the operating element 21.4.

The plug 34 is shown above the plug opening 69 shown in FIG. 5.

The top housing part 60 assembled as described in FIG. 5, with the rotary switch 50, is connected to the bottom housing part 40 described in FIG. 4 with the slide element 21 and the printed circuit board 30. For this purpose, the top housing part 60 is placed onto the bottom housing part 40. The tab-like latching elements 43 of the bottom housing part 40 are pushed into the recesses 63 of the top housing part 60. The latching cams 63.1 are thus latched into the latching receptacles 43.1. By virtue of this latching connection, the top housing part 60 is securely connected to the bottom housing part 40. The top side walls 60.2, 60.3 stand on the bottom side walls 40.2, 40.3 such that the contact space 12 is closed dust-tightly in this region. The top housing part 60 is aligned with the bottom housing part 40 in the region of the front walls 40.4, 60.4 by corresponding engagement of the connecting tabs shown in FIG. 3 in corresponding receptacles on the top housing part 60. The mutual alignment is moreover effected by engagement of the positive-locking elements 41.3 integrally formed on the bottom sealing ring receptacle 41 (see FIG. 3) in the positive-locking counter-elements 61.3 shown in FIG. 5 of the top sealing ring receptacle 61.

The front sealing rings 23.1, 23.2 are retained circumferentially and axially by the bottom and top sealing ring receptacles 41, 61. The operating element 21.4 is thus inserted in sealed fashion into the contact space 12 of the switch housing. The paired design of the front sealing rings 23.1, 23.2 results in a particularly good sealing in this region which is highly contaminated during operation of an electrical device. The passage of the rotary switch 50 into the contact space 12 is likewise sealed in the region of the annular projection 54.2 shown in FIG. 5 by the sealing ring 55. The top partition wall 68 shown in FIG. 5 and the bottom partition wall 49 shown in FIG. 3 each bear against the printed circuit board 30 from one side. As a result, the contact space 12 is also closed dust-tightly here with respect to the environment. The requirements for sealing are here such that dust or dirt cannot penetrate into the contact space 12 without additional external influences. External influences could, for example, be differences in air pressure between the contact space 12 and the environment with an exchange of air caused thereby.

In the mounting situation shown, the sliding contacts 22.1, 22.2 of the slide control 20 are, as described with reference to FIG. 4, pressed against the resistance tracks on the sliding resistor side 35 of the printed circuit board 30. Moreover, depending on the rotated position of the activating element 54, the contacts 51.1, 51.2 of the contact element 51 of the rotary switch 50 are pressed onto the respective contact surfaces 32.1, 32.2 or onto the counter-contact surface 32.3 on the switch side 31 of the printed circuit board 30. The first contact 51.1 is here conductively connected to the counter-contact surface 32.3 in all three rotated positions predetermined by the latching curve 52.1 and the latching element 53. In a first switch position, the second contact 51.2 is conductively connected to the first contact surface 32.1, in a second switch position conductively connected to the second contact surface 32.2, and in a third switch position is not connected at all to any of the contact surfaces 32.1, 32.2. Thus, for example, right-hand rotation of the electrical device can be set by the first switch position, and left-hand rotation by the second switch position. The electrical device is switched off in the third switch position.

FIG. 7 shows, in a perspective side view, in a fifth mounting stage, the fully mounted switch 10 shown in FIG. 1.

Compared with FIG. 6, the counter-bearing 70 is connected to the bottom housing part 40. For mounting, for this purpose the rear sealing ring 24 is first placed in the sealing ring receptacle 75. The spring 76 is then pushed with one end onto the centering pin 74 and is connected with the opposite end to a spring connection (not shown) on the operating element 21.4. This spring connection can, for example, be designed in the form of an axial blind bore in the rear sealing region 21.6 of the operating element 21.4, into which the end of the spring 76 is inserted. The counter-bearing 70 pre-mounted in this way is then pushed onto the bottom housing part counter to the spring force and latches onto the catches 46.1 of the bottom housing part 40 with its latching limbs 72 and latching recesses 72.1.

When mounted, the counter-bearing thus bears with its baseplate 71 against the bottom housing part 40. The latching limbs 72 are pushed into the receptacles 46 in the bottom side walls 40.2, 40.3 and the catches 46.1 are latched into the latching recesses 72.1. The counter-bearing 70 is thus connected securely to the bottom housing part 40. The guide sleeve 73 is pushed into the external sleeve 44 of the bottom housing part 40. The operating element 21.4 is passed with its rear sealing region 21.6 through the opening of the rear sealing ring 24 out of the contact space 12 of the switch housing. The protruding portion of the sealing region 21.6 projects into the interior of the guide sleeve 73. The operating element 21.4 thus encloses with its axial blind bore both the centering pin 74 and the compressed spring 76 pushed thereon.

The operating element 21.4 is passed, in sealed fashion, out of the contact space 12 and through the rear sealing ring 24. As a result, dust or dirt is prevented from accessing the contact space 12. The spring pretensions the operating element 21.4 and presses it toward the front shaft end 21.7. A user can move the operating element 21.4 counter to the spring force. A portion of the front sealing region 21.5 is thus pushed into the contact space 12. At the same time, a similarly sized portion of the rear sealing region 21.6 is pushed out of the contact space 12. The volume inside the contact space 12 displaced by the operating element 21.4 thus remains constant in all positions of the operating element 21.4. Thus, no air is displaced out of the switch housing or the contact space 12 or sucked into it during a setting procedure. This measure prevents dirt or dust being conveyed into the contact space 12 by sucked-in air. The described sealing of the contact space 12 is designed in such a way that it is not possible for any stirred-up dust or dirt to pass into the contact space 12, or that dust or dirt is displaced into the contact space 12 via the surface of the operating element 21.4. It is thus ensured that no dust or dirt, or very little, passes into the contact space 12. It is thus possible to provide open electrical switch and sliding contacts even for switches 10 which work with very low voltages and currents without them failing prematurely as a result of contamination. The switch 10 can thus be produced in a very cost-effective manner and nevertheless has a very long life expectancy and high degree of functional safety.

When activated as described, the rotary switch 50 does not cause any change in volume inside the contact space 12. The rotary switch 50 thus also causes there to be no undesired exchange of air between the contact space 12 and the environment.

In the switch position shown, the second contact 51.2 of the contact element 51 is arranged between the first and the second contact surface 32.1, 32.2 on the printed circuit board 30. The latching regions 53.3, 53.4 for this purpose engage in the central troughs of the latching curve 52.1 on the positioning element 52. In this switch position, the connected electrical device is switched off. Left-hand or right-hand rotation of the electrical device can, for example, be set by rotating the activating part 54. The selected switch position can be seen by the position of the knob 54.1.

As shown in FIG. 7, the plug 34 is pushed onto the plug contact 33 of the printed circuit board 30 and retained by the plug latching means 65. Not shown is that the plug 34 can be connected to a wiring harness and the signals of the switch 10 thus transmitted to a power electronics unit.

The invention claimed is:

1. A switch for an electrical device, the switch comprising:

a switch housing having a contact space defined therein;

first and second bushings mounted in the switch housing;

at least one printed circuit board received in the contact space of the switch housing; and a slide control configured to set a speed of the electrical device, the slide control including:

a plurality of electrical components mounted on the at least one printed circuit board; and an operating element movable through a range of adjustment positions, the operating element in all of the adjustment positions being in sliding and sealing engagement with and extending through the first bushing into the contact space and being in sliding and sealing engagement with and extending through the second bushing out of the contact space.

2. The switch of claim 1, wherein when the operating element is moved between adjustment positions a displaced volume of a portion of the operating element moving into the contact space deviates from a displaced volume of a portion of the operating element moving out of the contact space by no more than 10%.

3. The switch of claim 2, wherein the displaced volume of the portion of the operating element moving into the contact space and the displaced volume of the portion of the operating element moving out of the contact space are equal.

4. The switch of claim 1, wherein:

the plurality of electrical components include a plurality of resistance tracks applied to the printed circuit board; and the slide control includes a linear potentiometer including at least one sliding contact connected to the operating element, the sliding contact interacting with the resistance tracks.

5. The switch of claim 1, wherein:

the slide control includes a capacitive travel sensor including a slide connected to the operating element and received between at least two electrodes.

6. A switch for an electrical device, the switch comprising:

a switch housing having a contact space defined therein;

first and second bushings mounted in the switch housing;

at least one printed circuit board received in the contact space of the switch housing;

a slide control configured to set a speed of the electrical device, the slide control including:

a plurality of electrical components mounted on the at least one printed circuit board; and an operating element movable through a range of adjustment positions, the operating element extending in all of the adjustment positions in sealing engagement through the first bushing into the contact space and in sealing engagement through the second bushing out of the contact space;

a counter-bearing attached to the switch housing and defining a spring receptacle arranged outside the contact space; and a spring received in the spring receptacle and operatively engaged with the operating element to bias the operating element.

7. The switch of claim 1, further comprising:

a rotary switch including:

a rotary switch activating part;

at least one rotary switch contact element;

a rotary seal; and a connection part between the rotary switch activating part and the at least one rotary switch contact element, the connection part extending through the rotary seal into the contact space.

8. A switch for an electrical device, the switch comprising:

a switch housing having a contact space defined therein;

first and second bushings mounted in the switch housing;

at least one printed circuit board received in the contact space of the switch housing;

a slide control configured to set a speed of the electrical device, the slide control including:

a plurality of electrical components mounted on the at least one printed circuit board; and an operating element movable through a range of adjustment positions, the operating element extending in all of the adjustment positions in sealing engagement through the first bushing into the contact space and in sealing engagement through the second bushing out of the contact space;

a rotary switch including:

a rotary switch activating part;

at least one rotary switch contact element;

a rotary seal; and a connection part between the rotary switch activating part and the at least one rotary switch contact element, the connection part extending through the rotary seal into the contact space;

a plurality of contact surfaces arranged on the printed circuit board; and wherein depending on a position of the rotary switch activating part the at least one rotary switch contact element is in electrically conductive connection with at least one of the contact surfaces or with none of the contact surfaces.

9. A switch for an electrical device, the switch comprising:

a switch housing having a contact space defined therein;

first and second bushings mounted in the switch housing;

at least one printed circuit board received in the contact space of the switch housing;

a slide control configured to set a speed of the electrical device, the slide control including:

a plurality of electrical components mounted on the at least one printed circuit board; and an operating element movable through a range of adjustment positions, the operating element extending in all of the adjustment positions in sealing engagement through the first bushing into the contact space and in sealing engagement through the second bushing out of the contact space; and a rotary switch including:

a rotary switch activating part;

at least one rotary switch contact element;

a rotary seal;

a connection part between the rotary switch activating part and the at least one rotary switch contact element, the connection part extending through the rotary seal into the contact space;

a latching element fastened to the switch housing; and a positioning element attached to and rotatable with the activating part, the positioning element including a latching curve engaged with the latching element.

10. The switch of claim 1, further comprising:

an electrical connection extending from the printed circuit board out of the contact space and in a sealed fashion through the switch housing.

11. The switch of claim 1, wherein the switch housing further comprises:

a bottom housing part;

a top housing part; and a plurality of latching connections connecting the top housing part to the bottom housing part.

12. The switch of claim 1, wherein the switch is configured to operate with a voltage that is less than or equal to 12 V, and the switch is configured to supply output signals to a power electronics unit.

* * * * *